United States Patent [19]

Kasahara et al.

[11] Patent Number: 4,992,645

[45] Date of Patent: Feb. 12, 1991

[54] CASH HANDLING DEVICE

[75] Inventors: Hisayuki Kasahara; Shinsuke Kawamoto, both of Nara, Japan

[73] Assignee: Sharp Kabushiki Kaisha, Osaka, Japan

[21] Appl. No.: 374,917

[22] Filed: Jul. 3, 1989

[30] Foreign Application Priority Data

Jul. 4, 1988 [JP] Japan ..... 63-167177
Jul. 4, 1988 [JP] Japan ..... 63-167178

[51] Int. Cl.[5] ..... G06C 5/02; G07G 1/00
[52] U.S. Cl. ..... 235/1 D; 235/2
[58] Field of Search ..... 235/1 D, 1 E, 1 R, 2–7 A

[56] References Cited

U.S. PATENT DOCUMENTS 4,027,140 5/1977 Fowler et al. ..... 235/7 R
4,280,034 7/1981 Ezaki ..... 235/1 D
4,295,036 10/1981 Tsui ..... 235/1 E
4,791,278 12/1988 Hudson et al. ..... 235/7 R
4,803,346 2/1989 Lyons et al. ..... 235/7 R

FOREIGN PATENT DOCUMENTS 0189691 8/1986 European Pat. Off. .
2361302 6/1978 Fed. Rep. of Germany .
8714986 6/1988 Fed. Rep. of Germany .
8716522 8/1988 Fed. Rep. of Germany .
2570856 3/1986 France .
2579345 9/1986 France .
7900514 8/1979 PCT Int'l Appl. .

*Primary Examiner*—Benjamin R. Fuller
*Attorney, Agent, or Firm*—Birch, Stewart, Kolasch & Birch

[57] ABSTRACT

A relatively low profile cash handling device or register for mounting on a support structure such as a table having a recess in its upper surface. The cash register includes an upper body portion on which the operation keys, the display portion and the printer are located and a lower drawer housing being located beneath and integral with the upper body portion, for covering and protecting both sides of the drawer and accommodating the drawer slidably movable therein, with the lower drawer housing including a lower section having a smaller width dimension relative to the front of the cash handling device than the width dimension of the upper body portion, and the lower drawer housing having an outwardly extending flange portion for contacting and being supported by the upper surface of the table so that the lower secetion and the drawer resides in the recess when mounted thereon. The upper body portion is integrally formed together with the lower drawer housing portion by means of synthetic resin.

5 Claims, 7 Drawing Sheets

CASH HANDLING DEVICE

BACKGROUND OF THE INVENTION

1. Field of the Invention

The present invention relates to a cash handling device such as a cash register which is installed in various types of stores for totalizing the commodities transactions and a cash till which is installed in a bank.

2. Description of the Prior Art

Recently, stores whose interior design is unified, including the facilities and equipments to be installed therein, has been increasing. Typical examples are boutiques, coffee shops, etc. Therefore, a cash register which is to be installed in these stores requires designs tailored to the interior design of each store.

FIG. 1 for example, discloses, a perspective view of a cash register 1 in accordance with the known prior art. The cash register 1 comprises a body portion 7 including an upper casing 9 and a lower casing 10 that electronic circuits, etc. can be accommodated therein and a drawer housing portion 14 in which a drawer 12 of a cash box is housed. The body portion 7 is comprised of an operation portion 6 equipped with a key switch 11 on the surface 3 faced upwards and a protrusion 5 which protrudes upwards in FIG. 1 from the operation portion 6. A display portion 8 which can display transaction data is provided at the forward side of the protrusion 5, and a printer 4 which can issue a receipt and a journal is installed at the left side of the display portion 8'.

FIG. 2 is a sectionl view of a cash register taken along the sectional line II—II of FIG. 1. The body portion 7 and the drawer housing portion 14 of the cash register 1 are independently configured. More particularly, the drawer housing portion 14 is composed of a rectangular structure made of metal, and the body portion 7 is composed of an upper casing 9 and a lower casing 10, which are made of plastic resin, etc. The body portion 7 and the drawer housing portion 14 are fastened together by fitting bolts 15*a* and 15*b* in bosses 17*a* and 17*b* provided at the upper part of the money drawer housing portion 14 through through-holes 16*a* and 16*b* located at the bottom of the lower casing 10.

It is necessary for the printer 4 to accommodate a journal paper 19 and a receipt paper, each of which is a roll of paper. The printer 4 must also accommodate journal paper 20 which is printed out and wound by a printing mechanism 18. For this reason, the printer 4 is required to have a comparatively large capacity. A protrusion 5 which extends upwards from the operation portion 6 is installed in the cash register 1, thereby providing a space for the above journal paper 19 and 20'.

FIG. 3 is a simplified sectional view of the cash register 1 taken along the sectional line III—III in FIG. 1. In the cash register 1, the width W2 of the money drawer housing portion 14 is larger than that W1 of the body portion 7. Therefore, the cash register 1 is relatively large-sized.

In the cash register 1 of the above prior art, since the drawer housing portion 14 is made of metal, the weight thereof is also increased. Furthermore, the width W2 of the drawer housing portion 14 being larger than that W1 of the body portion 7, the outside profile of the cash register 1 may give customers an oppressive feeling.

Also, in the case of changing the design of this type of cash register 1, it is conventionally usual that the design of only the body portion 7 be changed. The design of the cash register 1 can not be completely changed. Therefore, it is difficult to change the design of the cash register to a novel one according to changes of the times. Moreover, since the drawer housing portion 14 and the body portion 7 are independently constructed, the number of component parts is increased, thereby causing the production cost to be accordingly increased.

Still further, since a protrusion 5 is provided in order to accommodate the printer 4 in the cash register 1 in the above prior art, the height of the cash register 1 becomes relatively high and the outside profile thereof is appears very large. And a design becomes uniform. Therefore, the cash register 1 like that shown in FIG. 1 may not match respective interior designs of some types of stores and may therefore cause a sense of incongruity.

SUMMARY OF THE INVENTION

It is an object of the invention to provide a cash handling device which can solve the above technical problems, whose weight and size can be reduced and whose production cost can be also reduced.

It is another object of the invention to provide a cash handling device which can enhance the beauty thereof by solving the above technical problems, reducing the size thereof and structuring it with novel design.

In order to accomplish the above-mentioned purposes, a cash handling device disclosed by the invention has operation means for input operation of cash handling data, a display portion to display the cash handling data, a printer to print out the cash handling data and a drawer to accommodate cash, and which comprises;

an upper body portion on which the operation means, the display portion and the printer are locatted; and a lower drawer housing being located beneath and intergral with the upper body portion, for covering and protecting both sides of the drawer and accompanying the drawer slidably movable therein; the lower drawer housing including a lower section having a smaller width dimension relative to a front of the cash handling device than a width dimension of the upper body portion; the lower drawer housing having an outwardly extending flange portion for contacting and being supported by the upper surface of said support structure so that said lower section and said drawer resides in said recess when mounted thereon.

The invention also presents a cash handling device a printer to print out cash handling data on recording roll paper and a drawer to accommodate cash which are housed in a casing, in which the drawer is housed in a lower part of the casing and at least a part of the printer is disposed behind the drawer.

In a preferred embodiment, at least a part of the body portions is integrally formed together with the drawer housing portions with synthetic resin.

In another preferred embodiment, a surface of the upper part of the body portions is inclined toward the back side from the front side of the body portions, with the back side being higher than the front side.

In still another preferred embodiment, the body portions are assembled with a detachable cover for covering a printer, the cover provided with a receipt discharge portion opening to outward, the printer discharging a receipt roll paper from the receipt discharge portion.

According to the invention, in a cash handling device having means for input operation of cash handling data, a display portion to display the cash handling data, a printer to print out the cash handling data and a drawer to accommodate cash, the body portion is equipped with the input operating means, the display portion and the printer, and the drawer is slidably accommodated in the drawer housing portion. The drawer housing portion is located downwards of the body portion and covers at least the sides of the drawer. At least a part of the body portion and the drawer housing portion consists of synthetic resin and they are integrally fastened together. Therefore, the cash handling device can be constructed with an integrally compact design including the body portion and the drawer housing portion. An oppressive perception which is described in relation to the prior art can be alleviated, and the weight can be also reduced.

Since the width of the drawer housing portion is made smaller than that of the body portion, the cash handling device can be compactly installed on a table where a concave portion of a specified size is provided, with the drawer housing portion thereof being fitted into the concave portion.

Also to the invention, in a cash handling device so composed that a printer to print out the cash handling data on a recording sheet of paper and a drawer to accommodate cash can be housed in a casing, the drawer is housed below the casing, and at least a part of the component members of the printer is arranged behind the drawer. Therefore, there is no need to install a protrusion on the casing in order to secure the space for accommodating a printer. Therefore, the whole device to be reduced in size and the upper surface of the casing can be made to be roughly flat.

As set forth in the foregoing description and according to the invention, as the body portion and the drawer housing portion of the cash handling device are integrally molded in a body with the same synthetic resin material, it is now possible to provide an integrally compact design to both the body portion and the drawer housing portion. Moreover, since the cash handling device can be compactly installed, an uneasy feeling of the cash handling device can be removed and the number of component parts can be reduced, thereby causing the production cost to be decreased.

Still further according to the invention, since the upper face secured on the casing having the operation portion can be roughly flat, a compact and novel design can be secured and the appearance thereof can be enhanced. Therefore, it is possible to provide a cash handling device having a design matching its place of installation.

BRIEF DESCRIPTION OF THE DRAWINGS

These and other objects, advantages and/or feature of the invention will become more apparent in the ensuring detailed description and the drawings attached hereto.

DETAILED DESCRIPTION OF THE PREFERRED EMBODIMENTS

The preferred embodiment of the invention is described in details with reference to the drawings attached thereto.

Figure 1:
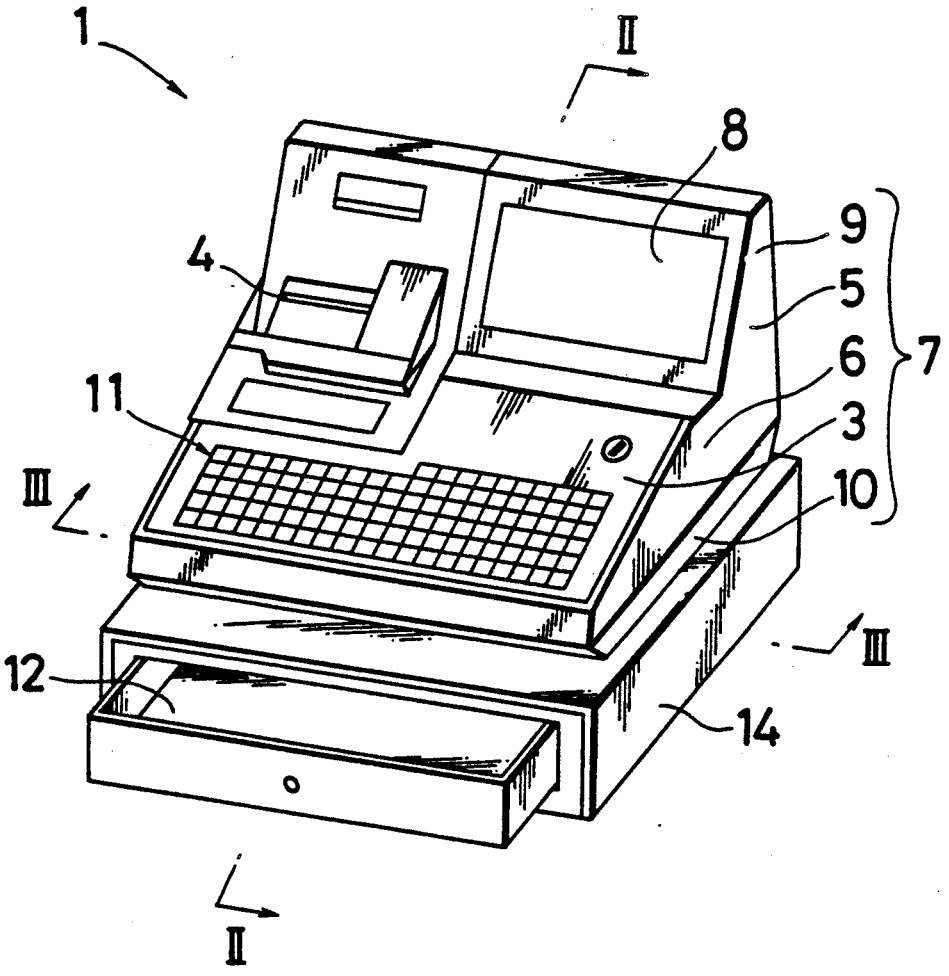
Fig.1 Prior art
FIG. 1 is a perspective view of a cash register 1 of the prior art.
Figure 2:
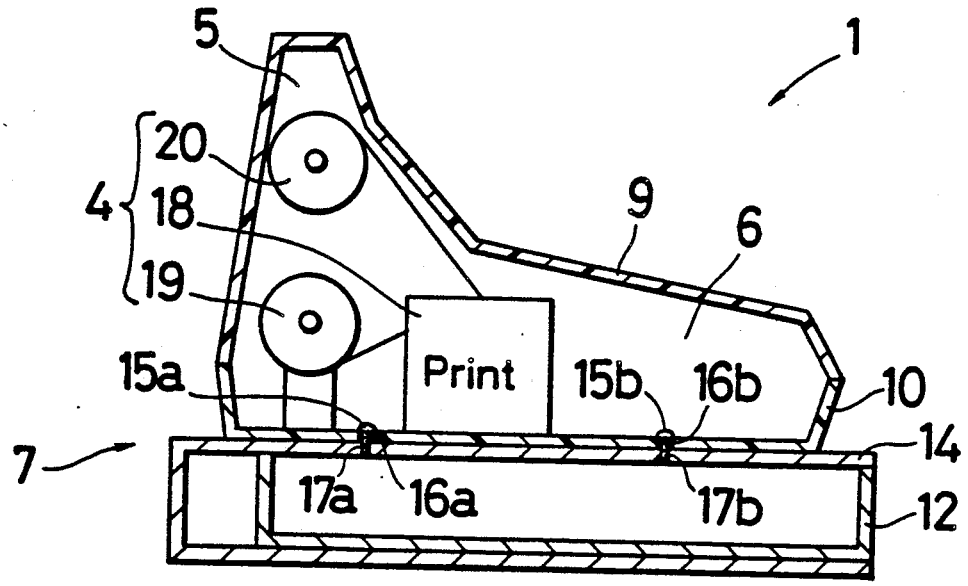
Fig.2 Prior art
FIG. 2 is a sectional view of the cash register 1 taken along the sectional line II—II of FIG. 1.
Figure 3:
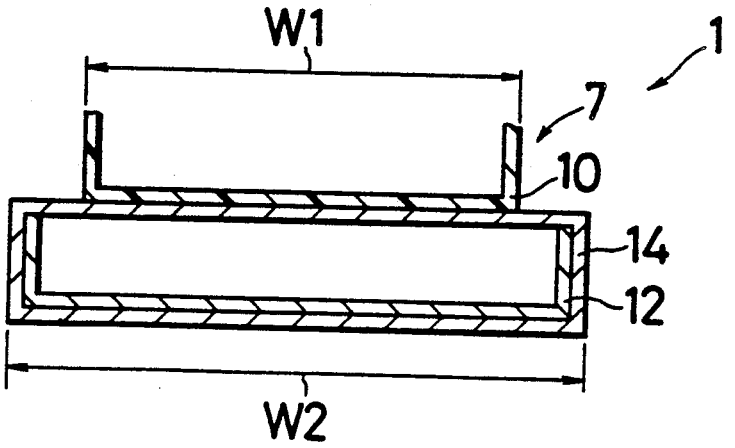
Fig.3 Prior art
FIG. 3 is another sectional view of the cash register 1 taken along the sectional line III—III of FIG. 1.
Figure 4:
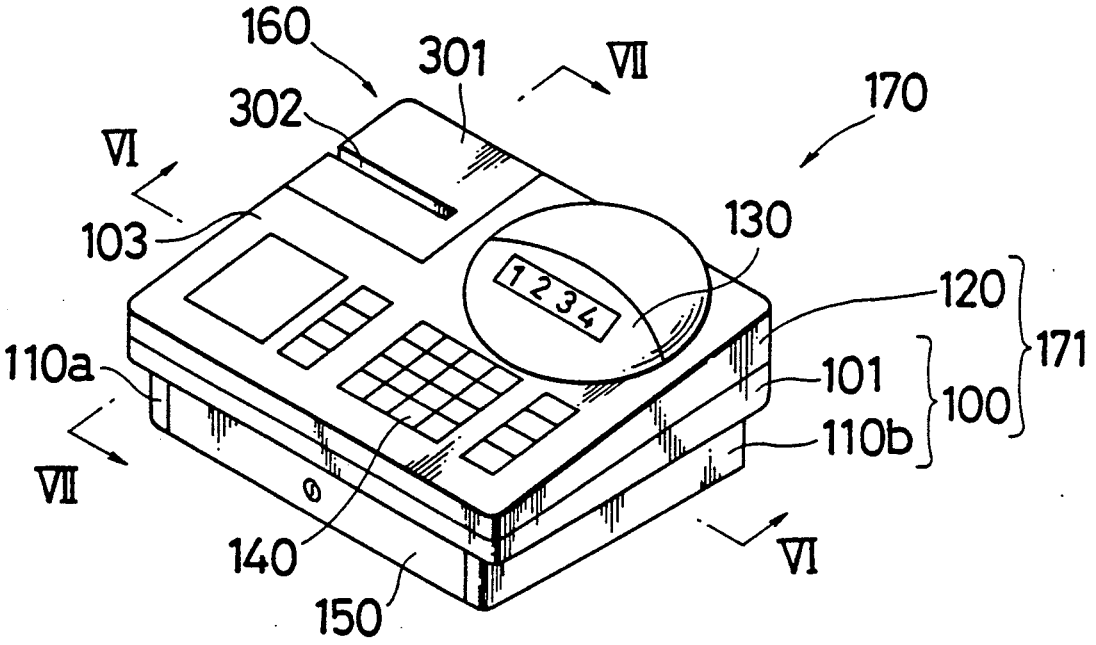
FIG. 4 is a perspective view of a cash register according is one of the preferred embodiments of the invention.

FIG. 4 is a perspective view showing the appearance of the cash register 170 which is one of the embodiments of the invention. The cash register 170 is installed in a store and used for totalizing the cash handling data in relation to the commodities transaction. The cash register 170 which is a cash handling device has electronic circuits, hereinafter described in detail, located in the casing 171. casing 171 consists of an upper the casing 120 and a lower casing 100. The lower casing 100 is comprised so that the lower casing body 101 and the drawer housing portions 110*a* and 110*b* can be integrally molded with synthetic resin, thereby causing the body portion to be fabricated so as to include the lower casing body 101 and the upper casing 120.

Numeral keys and various kinds of control keys of the cash register 170 are arranged on the upper surface 103 of the upper casing 120. An operation input portion 140 which comprises operating means upwardly protruding, displaying means 130 which is semi-spherical and accommodates display elements therein, and a discharge port 302 to discharge a receipt are all formed on the surface 103. The surface 103 is inclined to back with, the back side of being higher than the front side. As described later, a part in the vicinity of the discharge port 302 of the upper casing 120 is composed by a cover 301. A printer 160 including a receipt roll paper and journal paper of a recording sheet is accommodated beneath this cover 301. The cover 301 which is removably mounted on the upper casing 120 can be removed when replacing a receipt roll paper or journal roll paper.

Paper money and coins are accommodated in the drawer 150. The drawer 150 is slidably supported in the drawer housing portion 110*a* and 110*b* at both the sides thereof by the ensuing construction.

Figure 5:
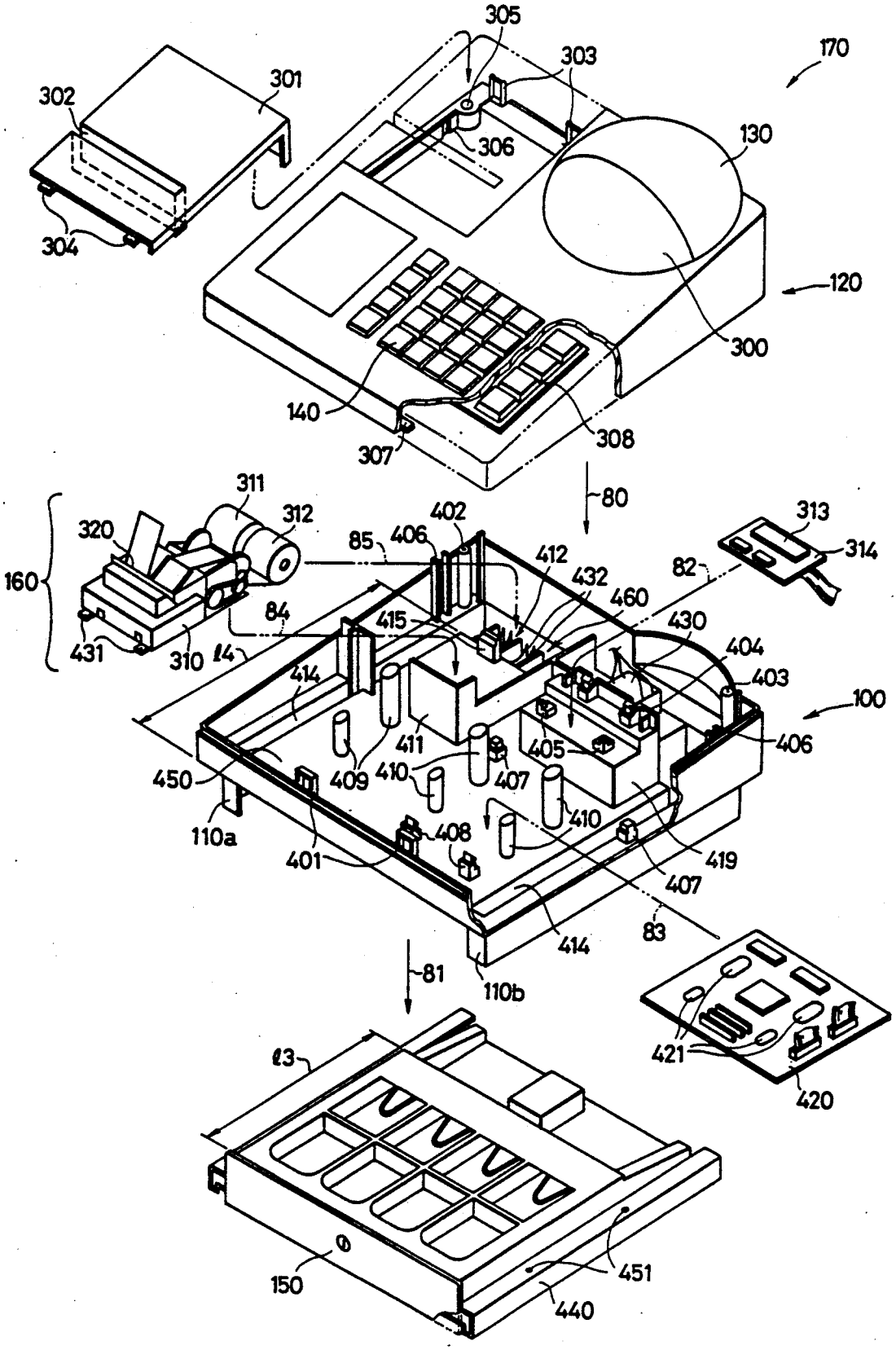
FIG. 5 is an exploded perspective view of the cash register shown in FIG. 4.

FIG. 5 is an exploded perspective view of the cash register 170. The upper casing 120, the lower casing 100 and the drawer 150 are assembled so as to be arranged as shown with arrows 80 and 81 in FIG. 5.

The upper casing 120 is produced by molding synthetic resin and is provided with the operation input portion 140, the cover 301 and the display cover 300 of the displaying means 130. The display cover 300 is made of for instance semi-transparent acrylate resin plate.

The operation input portion 140 consists of various kinds of key switches which are formed on the substrate 308, and this substrate 308 is attached to the upper casing 120 by a fitting mechanism not shown.

A receipt discharge portion 302 is formed at the cover 301. The receipt discharge portion 302 extends up to the vicinity of the receipt discharge portion 320 in order to discharge a receipt roll paper 311 of the printer 160 arranged beneath the cover 301 as described later. In addition, this cover 301 is furnished with pawls 304 to attach the cover 301 to the upper casing 120. The upper casing 120 has loose insertion holes (not illustrated herein) through which the pawls 304 are inserted. Engaging pawls 303 to be engaged with the protrusions (not illustrated) provided on the cover 301 are formed on the upper casing 120. Thus, the cover 301 is removably mounted on the upper casing 120.

The lower casing 100 is produced by integrally molding synthetic resin, and this lower casing 100 is provided with an electronic circuit board 420 on which semi-conductor elements are mounted, a displaying substrate 314 to which displaying elements 313, for instance, light emitting diodes, etc., are attached and a printer 160, respectively.

The bottom surface 450 of the lower casing 100 is raised by an amount l4 corresponding to the depth l3 of the drawer 150, thereby causing the space in which the drawer 150 is accommodated to be formed. At both the ends of this bottom 450, the drawer housing portions 110*a* and 110*b* are formed so that they can protrude downwards from this bottom surface 450 in FIG. 5, so that they cover the drawer 150 and support the supporting chasis 440 of the drawer 150.

Furthermore, a concave portion 460 which extends almost to the bottom surface of the drawer 150 is provided at the rear part of the lower casing 100. This concave portion 460 is provided with a storage portion for a receipt roll paper 311 and a journal roll paper 312 of the printer 160 which needs a comparatively large capacity. In addition the concave portion 460 also accommodates a power source unit 430.

A staircase-like protrusion 419 by which the display substrate 314 is arranged in the vicinity of the display portion 130 of the upper casing 120 is formed at the right rear portion of the bottom surface 450 of the lower casing 100 in FIG. 5. And a pair of substrate engagement portions 405 and a pair of engagement pawls 404 are formed on the upper face of this staircase-like protrusion 419, thereby causing the display substrate 314 to be fixed so as to be inclined forwards in FIG. 5 as shown by an arrow 82.

A pair of the substrate engagement portions 407 and a pair of engagement pawls 408 are formed at the right forward portion of the bottom surface 450 of the lower casing 100 in order to fix the electronic circuit board 420. Additionally column-like protrusions 409 and 410 are formed on the button surface 450. Then, the column protrusion 410 is inserted in an opening 421 of the electronic circuit board 420. The above mentioned construction can allow the circuit board 420 to be located and fixed at the required position of the lower casing 100 as shown with an arrow 83.

The upper end of the column protrusions 409 and 410 are brought into downward contact with the board 308 of the operation input portion 140 in FIG. 5, thereby causing the operation input portion 140 to be prevented from shaking due to distortion of the board 308.

An accommodation space for the printer 160 is formed by a shielding wall 411 at the left rear portion of the bottom surface 450 of the lower casing 100. As mentioned in the above, an accommodation portion 412 of a receipt roll paper 311 and a journal roll paper 312 is formed at the rear portion of this accommodation space of the printer 160. A printing mechanism 310, in which a mechanism for feeding and printing the receipt roll paper 311 and another mechanism for feeding and printing the journal roll paper 312 are linked together, is formed in the printer 160. Also a pair of engagement pawls 431 is formed at the front side of the printing mechanism 310 in FIG. 5. These engagement pawls 431 are fitted to the supporting portions (not illustrated) which are formed on the shielding wall 411. The rear part of the printing mechanism 310 is inserted into the engagement portion 415. Such a construction as mentioned in the above can allow the printer 160 to be positioned as shown with an arrow 84 in the lower casing 100.

The shielding wall 411 is provided so as to prevent foreign substances from entering the electronic circuits portion when replacing the journal roll paper 311 or the receipt roll paper 312 and is so constructed that the shielding wall 411 can be joined with another shielding wall (not illustrated) formed at the corresponding position of the upper casing 120.

The accommodation portion 412 to accommodate the receipt roll paper 311 and the journal roll paper 312 is provided with a plurality of circular protrusions 432 so that the receipt roll paper 311 and the journal roll paper 312 can rotate by tension of the paper feeding mechanism provided on the printer 160, and the receipt roll paper 311 and the journal roll paper 312 are placed on these protrusions 432 as shown with an arrow 85.

In relation to the linkage between the upper casing 120 and the lower casing 100, an engagement pawl 307 which protrudes inwardly is formed at the inner wall at the front part of the upper casing 120, and this engagement pawl 307 is joined to the engagement portion 401 of the lower casing 100. Furthermore, the upper casing 120 and the lower casing 100 are attached together in a position by means of a guide protrusion 306 provided on the upper casing 120 and another guide protrusion 406 provided on the lower casing 100. Under this condition, a bolt is inserted in a boss 305 of the upper casing 120 by way of an insertion hole 402 secured on the lower casing 100, and another bolt is inserted into a boss (not illustrated) of the upper casing 120 by way of the insertion hole 403 of the lower casing 100, thereby causing the upper casing 120 and the lower casing 100 to be tightly fastened together.

The drawer 150 is produced by molding synthetic resin and is slidably supported on the metal supporting chasis 440 as shown and described later. A threaded groove 451 is formed at the upper surface at both the sides of this supporting chasis 440, and a bolt, etc. is inserted through an opening (not illustrated) secured at the bottom part of the concave portions 414 of the lower casing 100. Thus the drawer 150 is fixed at the lower casing 100. Besides, the drawer housing portions 110*a* and 110*b* of the lower casing 100 fix the supporting chasis 440 and cover both the sides of the drawer 150 at the same.

Figure 6:
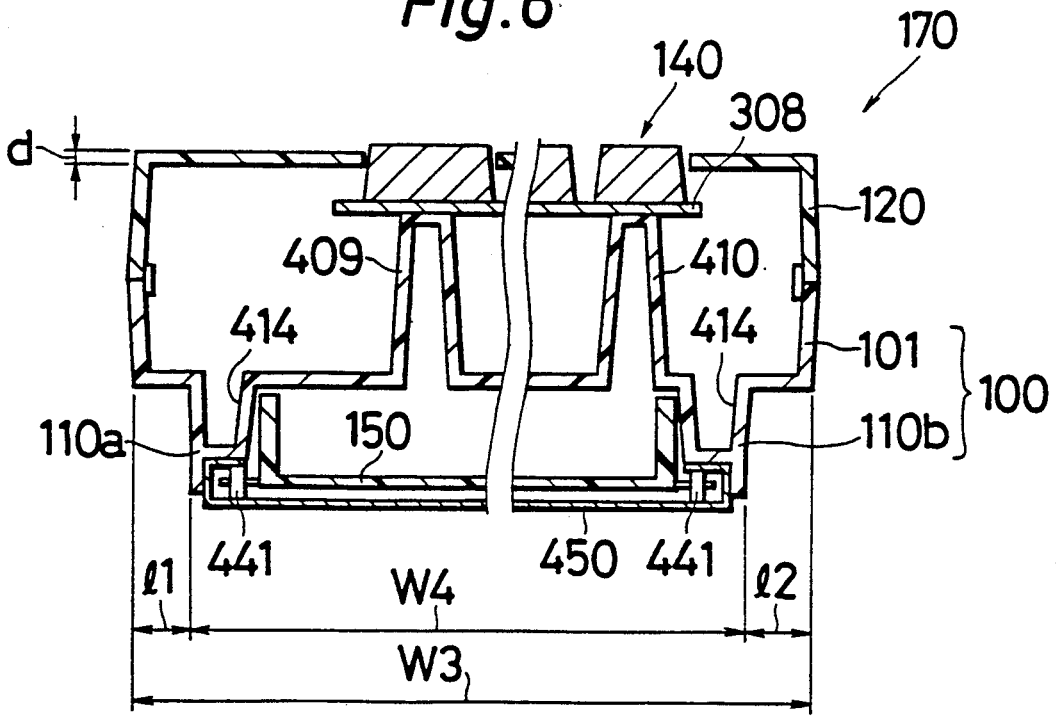
FIG. 6 is a sectional view of the cash register shown in FIG. 4 taken along the sectional cut line VI—VI.

FIG. 6 is a sectional view of the cash register 170 as observed along the section line VI—VI of FIG. 4. A draft is secured on the concave portions 414 by which the drawer housing portions 110*a* and 110*b* are formed, in the lower casing 100, in relation to that this lower casing 100 is produced by molding. Namely, the width of this concave portions 414 becomes downwardly narrow. The drawer housing portions 110*a* and 110*b* are of double structure consisting of the concave portions 414, as illustrated in FIG. 6, in order to keep the thickness "d" of the lower casing 100 constant. A draft is also secured at the column protrusions 409 and 410 mentioned in the above as well, and the width of the column protrusions 409 and 410 becomes upwardly. A pair of rollers 441 is equipped at both the sides of the drawer 150 in FIG. 6, thereby causing the drawer 150 to be slidably supported on the supported on the supporting chasis 450.

The width W3 of the lower casing body 101 of the lower cage 100 is made longer than the width W4 in the drawer housing portions 110*a* and 110*b*. Namely, in FIG. 6, the left side of the lower casing body 101 protrudes to the left by the length l1 from the left side of the drawer housing portion 110*a*, and the right side of the lower casing body 101 protrudes to the right by the length l2 from the right side of the drawer housing portion 110*a*, thereby causing the cash register 170 to be installed as shown in FIG. 8.

Figure 7:
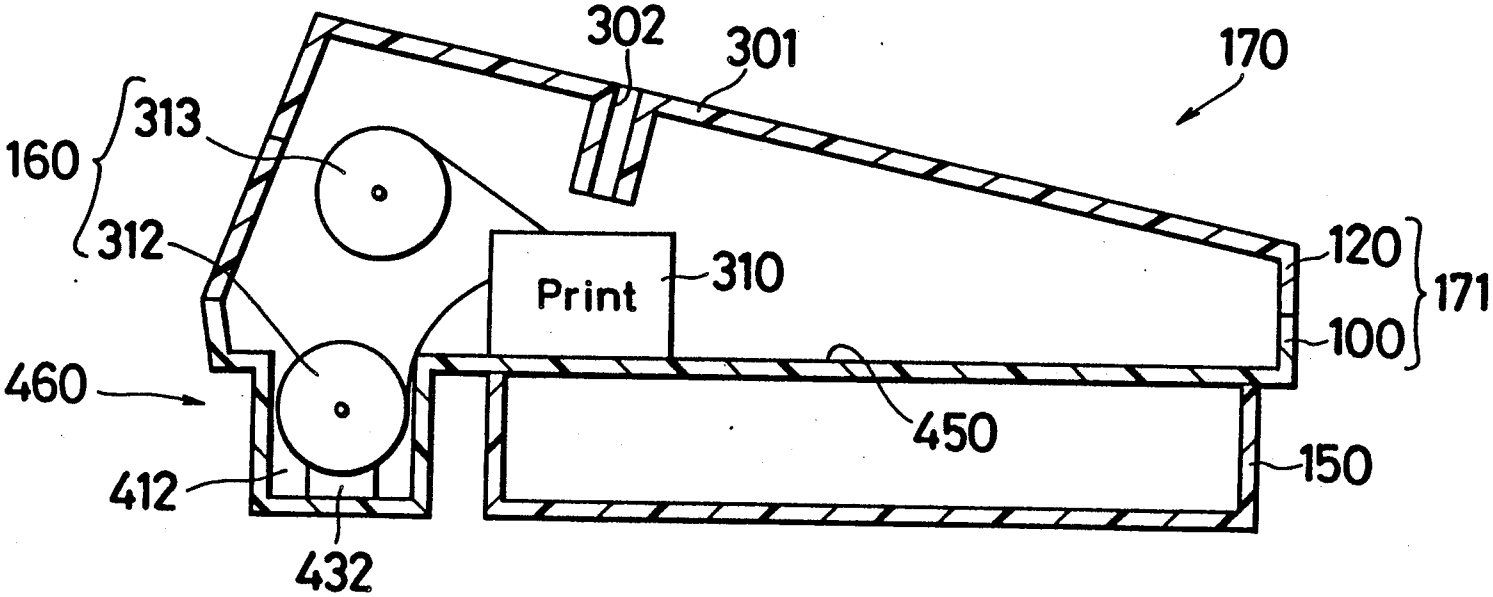
FIG. 7 is a sectional view of the cash register shown in FIG. 4 along the sectional cut line VII—VII.

FIG. 7 is a sectional view of the cash register 170 as observed along the sectional line VII—VII of FIG. 4. An accommodation portion 412 of the concave portion 460 is secured behind the position where the drawer 150 of the lower casing 100 is housed. The journal roll paper 312 which is a part of the printer 160 is placed on the circular protrusion 432 provided on this housing portion 412. The journal roll paper 312 is printed out by a printing mechanism 310 and is wound as journal roll paper 313. This journal roll paper 312 sticks out of and is positioned downwards from the bottom surface 450 of the lower casing 100 as shown in FIG. 7, thereby there is no need to provide a protrusion portion which protrudes upwards from the operation portion of the cash register, which is described with reference to the prior art, and it is now possible to provide an accommodation space for the printer 160.

Figure 8:
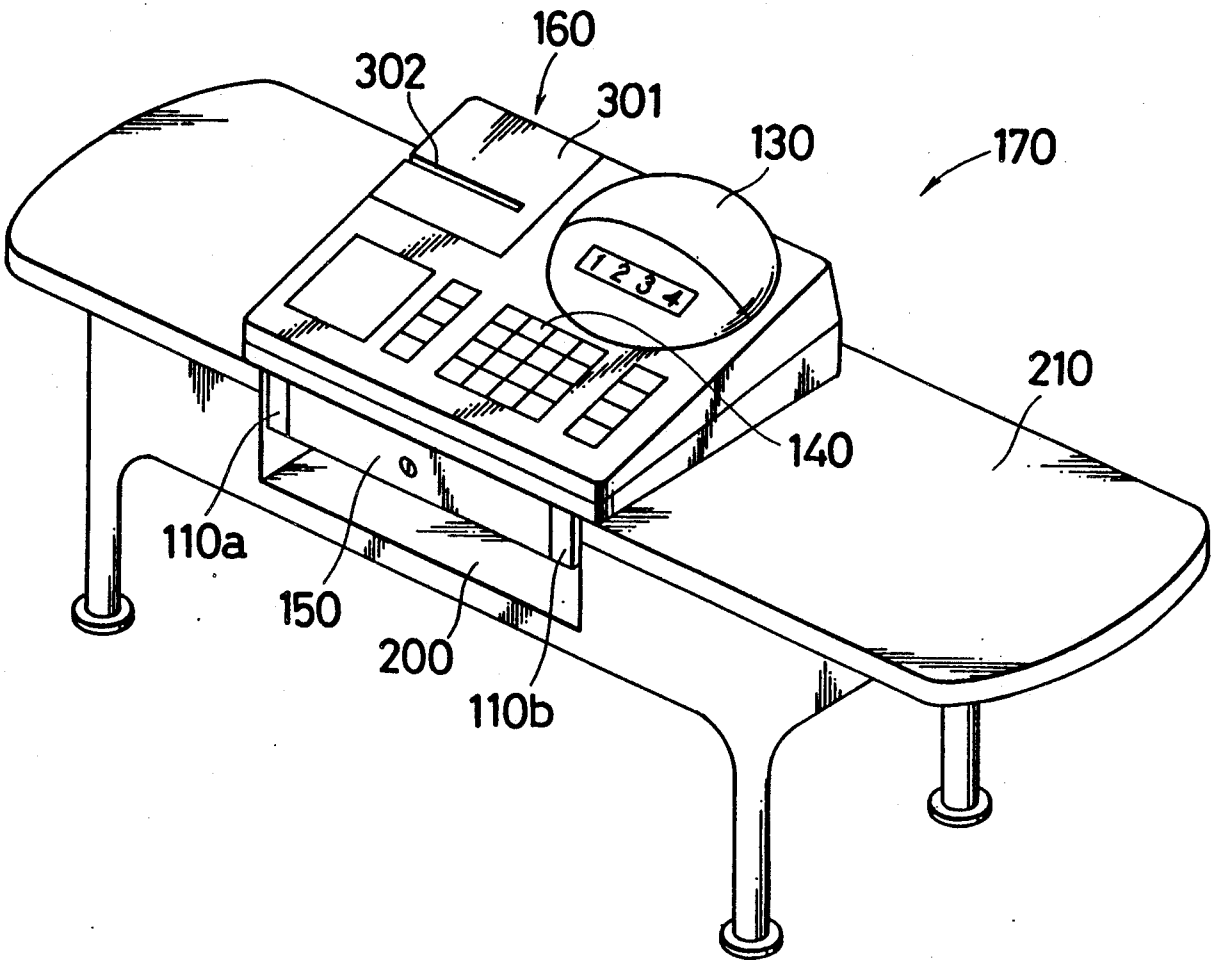
FIG. 8 is a perspective view illustrative of the cash register shown in FIG. 4 installed on a table.
Figure 9:
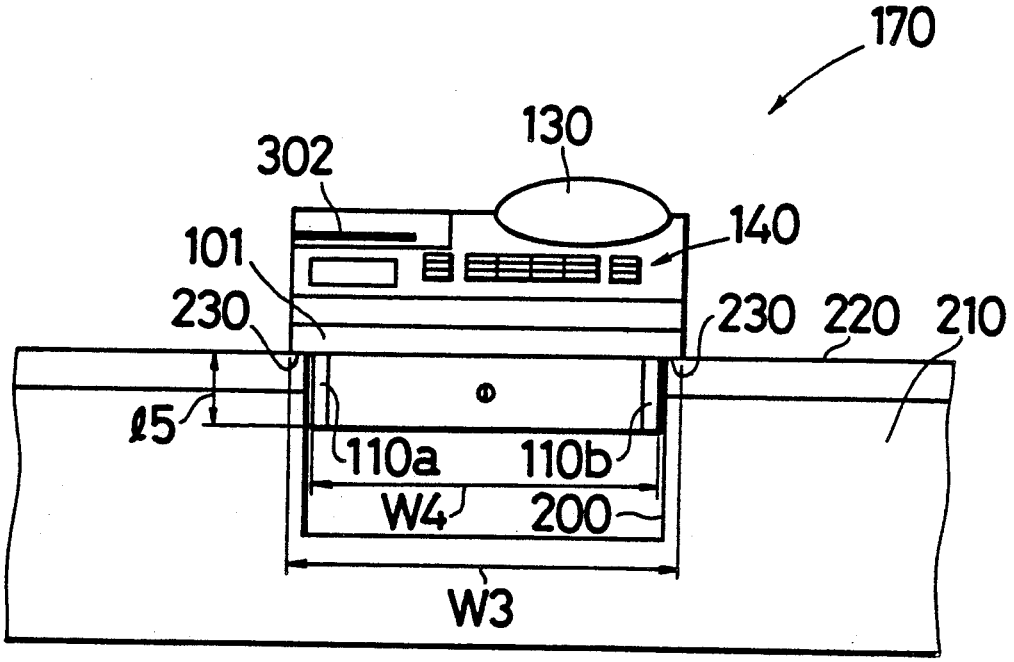
FIG. 9 is a front elevational view showing that the cash register placed on the table shown in FIG. 9.

FIG. 8 is a perspective view of the cash register 170 when placed on the table 210, and FIG. 9 is a front elevational view thereof. The table 210 has a concave portion 200 whose width is larger than the width W4 of the drawer housing portions 110*a* and 110*b* and is smaller than the width W3 of the lower casing body 101. Thereby the flange portion 230 of the lower casing body 101 is brought into contact with and is supported by the surface 220 of the table 210, and it becomes possible to place the cash register 170 on the table 210 so that the drawer 150 fits in the concave portion 200 of the table 210. Thus, it becomes possible to install the cash register 170 so that the height that the cash register 170 protrudes from the table surface 220 can be lowered by the dimension l5, thereby causing an oppressive perception due to installation of the cash register 170 to be further reduced.

As shown in the above, by integrally forming the lower casing body 101 and the drawing housing portions 110*a* and 110*b* together with the lower casing 100 in a common body, it is possible to lighten the weight of the cash register and to realize a compact and novel design for the cash register 170. Furthermore, the number of component parts can be reduced, thereby causing the production cost to also be reduced.

Also by installing the printer 160 so that it can stick out of the bottom surface 450, a protrusion of the cash register, which has been described in the foregoing description with reference to the prior part, can be eliminated and the key input portion 140, the display portion 130 and the cover 301 of the printer 160 can be provided in substantially the same flat level, thereby resulting in a cash register having a novel design that has not existed heretofore.

Although this embodiment has been explained with respect to a cash register, it is not limited to a cash register. For instance this invention can be applicable to some other device if it is a terminal machine on a POS (Point-of-sales system) or a cash handling device in relation to transaction data accompanied with money payment and reception, such as a cash till which is to be installed in a bank.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A relatively low profile cash handling device for mounting on a support structure having a recess in an upper surface thereof, said cash handling device having operation means for inputting cash handling data, a display portion to display the cash handling data, a printer to print out the cash handling data and a drawer to accommodate cash, said cash handling device comprising:;

an upper body portion on which the operation means, the display portion and the printer are located; and a lower drawer housing being located beneath and integral with the upper body portion, for covering and protecting both sides of the drawer and accommodating the drawer slidably movable therein;

the lower drawer housing including a lower section having a smaller width dimension relative to a front of the cash handling device than the width dimension of a upper body portion;

the lower drawer housing having an outwardly extending flange portion for contacting and being supported by the upper surface of said support structure so that said lower section and said drawer resides in said recess when mounted thereon.

2. The cash handling device as claimed in claim 1 wherein the upper body portion is integrally formed together with the lower drawer housing portion by means of synthetic resin.

3. The cash handling device as claimed in claim 1 wherein the upper body portion includes an outer top surface which is inclined upwardly front to back.

4. The cash handling device as claimed in claim 1 wherein the upper body portion includes a detachably mounted cover for covering the printer, the cover further including a receipt discharge opening for discharging receipt paper from a roll of paper located in a receipt discharge portion of said upper body portion.

5. The cash handling device as claimed in claim 1 wherein said upper body portion includes a body cavity at a bottom rear section thereof behind the drawer for holding a roll of receipt paper for use by the printer.

* * * * *